US010308901B2

(12) United States Patent
Pacifici

(10) Patent No.: US 10,308,901 B2
(45) Date of Patent: Jun. 4, 2019

(54) KIT FOR ADHESIVE REMOVAL ON SURFACES AND METHODS AND DEVICES THEREOF

(71) Applicant: Joseph Albert Pacifici, Anderson, SC (US)

(72) Inventor: Joseph Albert Pacifici, Anderson, SC (US)

(73) Assignee: The James Grady Co. Inc., Sandy Spring, SC (US)

( * ) Notice: Subject to any disclaimer, the term of this patent is extended or adjusted under 35 U.S.C. 154(b) by 0 days.

(21) Appl. No.: 15/212,455

(22) Filed: Jul. 18, 2016

(65) Prior Publication Data

US 2017/0022461 A1 Jan. 26, 2017

Related U.S. Application Data

(60) Provisional application No. 62/231,957, filed on Jul. 20, 2015.

(51) Int. Cl.
*C11D 7/50* (2006.01)
*C11D 17/04* (2006.01)

(52) U.S. Cl.
CPC ..... *C11D 7/5022* (2013.01); *C11D 17/049* (2013.01)

(58) Field of Classification Search
None
See application file for complete search history.

(56) References Cited

U.S. PATENT DOCUMENTS

| | | | | |
|---|---|---|---|---|
| 4,422,883 | A | 12/1983 | Lazar | |
| 5,525,254 | A | 6/1996 | Reininger | |
| 5,547,601 | A * | 8/1996 | Volpe | C11D 7/5022 15/104.93 |
| 5,612,303 | A * | 3/1997 | Takayanagi | A61K 8/37 134/40 |
| 5,856,285 | A | 1/1999 | Wiersma et al. | |
| 6,518,230 | B2 | 2/2003 | Wu et al. | |
| 8,772,215 | B2 * | 7/2014 | Ryther | C11D 3/044 510/218 |
| 2003/0148911 | A1 * | 8/2003 | Smith | A01N 25/02 510/417 |
| 2003/0228996 | A1 * | 12/2003 | Hei | A01N 25/02 510/382 |
| 2005/0136238 | A1 * | 6/2005 | Lindsay | A47L 13/16 428/304.4 |
| 2007/0161533 | A1 * | 7/2007 | Gonzales | C11D 3/39 510/438 |

(Continued)

FOREIGN PATENT DOCUMENTS

| | | | |
|---|---|---|---|
| JP | 09-013082 A * | 1/1997 | |
| WO | 2008/076603 A1 | 6/2008 | |

OTHER PUBLICATIONS

How to Remove Urethane/ehow, http://ehow.com/how 5163932 remove-urethane.html, Jun. 17, 2016, pp. 1-2.

(Continued)

*Primary Examiner* — Shamim Ahmed
(74) *Attorney, Agent, or Firm* — Seth L. Hudson; Clements Bernard Walker, PLLC

(57) ABSTRACT

The present invention provides a kit, method, and device for removing an adhesive from a surface that includes a micro-adhesive material, such as a foam, and a solvent composition.

8 Claims, 1 Drawing Sheet

(56) References Cited

U.S. PATENT DOCUMENTS

| | | | | |
|---|---|---|---|---|
| 2008/0273915 | A1* | 11/2008 | O'Connell | A45D 34/04 401/188 R |
| 2008/0283097 | A1* | 11/2008 | Simandl | C08J 3/18 134/19 |
| 2012/0152286 | A1* | 6/2012 | Doyel | C11D 7/263 134/26 |
| 2013/0048032 | A1* | 2/2013 | Johnson | C11D 7/20 134/37 |
| 2014/0057820 | A1* | 2/2014 | Lasik | C11D 7/34 510/109 |
| 2015/0210056 | A1* | 7/2015 | Bosshard | C03C 23/0075 156/281 |

OTHER PUBLICATIONS

Dri-tac Premium Flooring Adhesives; Urethane Adhesive Remover; retrieved on or about Jun. 18, 2016.
Urethane Glue Adhesive Removal; http://www.uptownfloors.com/tools/adhesive-removers.htm; dated Jun. 17, 2016 p. 1.
How to Remove Urethane; http://www.ehow.com/how 5163932 remove-urethane.html; dated Jun. 17, 2016 pp. 1-2.
Urethane Adhesive Remover Towelettes Dispenser (60-count); http://www.homedepot.com/p/Roberts-Urethane-Adhesive-Remover-Towelettes-Dispenser; retreived on or about Jun. 17, 2016; p. 1.
Dri-tac 7600 Premium Urethane Wood Flooring Adhesive; www.Dri-tac.com; retrieved on or about Jun. 1, 2017.
Roberts 1540 All-In-One Urethane Flooring Adhesive; www.robertsconsolidated.com; retrieved on or about Jun. 4, 2017.
Dri-tac Green Urethane Adhesive Remover for Use on Hardwood Floors Wipe-Aways Label; retrieved on or about Jun. 2015.
Hardwoodflooring Talk; Remove Roberts Urethane R1530 Adhesive Spots: Yikes I Have Problems!; http://www.addwoodfloors.com; retrieved on Nov. 1, 2016; p. 1.
Bostik Material Safety Data Sheet; Ultimate Towels; Material Name:G85839; Material ID:434DD; Version # 02; Revision Date Feb. 9, 2007.
Material Safety Data Sheet; Roberts R6605 Urethane/Multipurpose Adhesive Remover Towelettes; Effective Date Jun. 15, 2011.
Roberts Adhesive Remover R8100 OSUPERIOR Advertisement; retrieved on or about Jun. 18, 2016.
R5505 Superior Urethane/Multipurpose Adhesive Remover Advertisement; retrieved on or about Jun. 18, 2016.
Bostik Ultimate Adhesive Remover Advertisement; retrieved on or about Jun. 18, 2016.
Material Safety Data Sheet; DriTac Urethane Adhesive Remover; Issue Date Dec. 1, 2013.
DriTac Wipe-Aways "Green" Urethane Adhesive Remover (Towels) Brochure; http:/www.dritac.com/productsUR2.php; dated Jun. 17, 2016.
DriTac Wipe-Aways Urethane Adhesive Remover for Use on Hardwood Floors Advertisement; retrieved on or about Jun. 18, 2016.
Material Safety Data Sheet; Roberts R5505 Urethane/Multipurpose Adhesive Remover Towlettes; Effective Date Jun. 15, 2011.

* cited by examiner

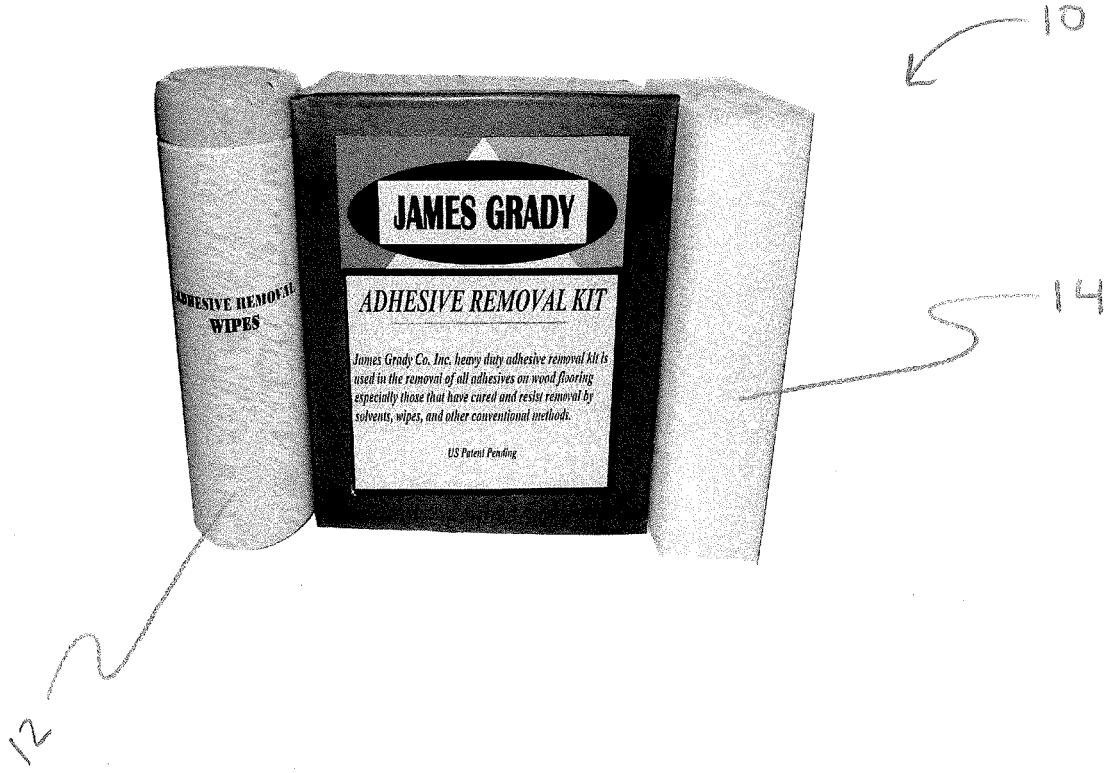
10
JAMES GRADY
ADHESIVE REMOVAL KIT
James Grady Co. Inc. heavy duty adhesive removal kit is used in the removal of all adhesives on wood flooring especially those that have cured and resist removal by solvents, wipes, and other conventional methods.
US Patent Pending
WIPES
14
12

KIT FOR ADHESIVE REMOVAL ON SURFACES AND METHODS AND DEVICES THEREOF

CROSS REFERENCE TO RELATED PATENT APPLICATION

The present non-provisional patent/patent applications claims priority to U.S. Provisional Patent Ser. No. 62/231,957 filed Jul. 20, 2015 and entitled "ADHESIVE REMOVAL ON HARD SURFACES," the contents of which are incorporated by reference herein.

FIELD OF THE INVENTION

The present invention relates generally to an apparatus for the removal of an adhesive from surfaces, and more generally relates to an open cell foam material and a solvent composition for the removal of an adhesive, such as urethane, from surfaces. The solvent composition may be disposed on a disposable cloth, in a can, pump sprayer or the like.

BACKGROUND OF THE INVENTION

In the last several years the use of hard surfaces in residential establishments such as homes, condos, apartments, etc has increased significantly over the use of soft surfaces such as carpets, and rugs. The trend now is for flooring in areas such as living rooms, dining rooms, dens, keeping rooms, etc to be made of hard surfaces, primarily wood. Wood flooring comes in a variety of types such as solid, engineered, and laminate hardwood. Wood flooring is either attached to a subfloor or non-attached (floating). Attached flooring can be installed in two ways. The flooring can be nailed down or glued down to the subflooring beneath. Subflooring is typically pressboard, plywood, or concrete. Sometimes a secondary subfloor such as cork is added for noise abatement.

The present invention is directed to the removal of an adhesive on a surface. Such hard surface may be wood flooring that has been attached using adhesives to keep the wood planks in place. A problem exists in some situations wherein adhesive that is smeared onto the wood flooring during the installation process cannot be easily removed if at all. This issue occurs when the installer does not remove smeared or excess glue off the boards in a timely manner. Some types of adhesives especially urethane based adhesives resist removal after the glue has cured. Typical removal processes involve cleaning the floors with solvents such as mineral spirits or using adhesive removal towels wipes or liquids.

There are many companies that manufacture adhesives wherein heavy and light smudges remaining on wood flooring would be difficult to remove after curing. A few examples of adhesive products from three of these companies are Roberts 1530, 1540, and 1409 Moisture Cure Urethane adhesives; DriTac 7600, 7500, and 7400 Urethane adhesives; and Bostik MVP and TKO adhesives. In addition to adhesives these companies supply adhesive removal towel wipes for use with their specific adhesive products. Roberts recommends the R5505 Wipes. DriTac recommends the Wipe-Aways, and Bostik recommends the Ultimate Towel. The wipes are treated with special solvent products unique to each company. They also provide adhesive removers in liquid form but the wipes are more convenient to use and reduce the possibility of over use.

Towel wipes are ineffective at adhesive removal if the adhesive has cured and the adhesive polymer has cross-linked and is no longer soluble in solvents. Some removal can be achieved but with some difficulty. It is an object of the present invention to provide a device, method, or kit that will remove the adhesive, such as urethane, after it has hardened on surface without damaging the underlying surface.

BRIEF SUMMARY OF THE INVENTION

According to yet another embodiment of the present invention, a kit for removing adhesives from a surface that includes a micro-abrasive material and a solvent composition.

According to yet another embodiment of the present invention, the kit for removing adhesives from a surface wherein the micro-abrasive material is an open cell foam.

According to yet another embodiment of the present invention, the kit for removing adhesives from a surface that includes the solvent composition contained on a disposable cloth.

According to yet another embodiment of the present invention, the kit for removing adhesives from a surface that includes the foam and solvent composition stored within a housing.

According to yet another embodiment of the present invention, the kit for removing adhesives from a surface that includes a micro-abrasive material that is a melamine foam.

According to yet another embodiment of the present invention, the kit for removing adhesives from a surface that includes a solvent composition composed of an alcohol, an ether, and a diacid ester.

According to yet another embodiment of the present invention, the kit for removing adhesives from a surface that includes a solvent composition composed of a benzyl alcohol, glycol ether, and dimethyl glutarate.

According to yet another embodiment of the present invention, the kit for removing adhesives from a surface that includes a solvent composition composed of diacid esters.

According to yet another embodiment of the present invention, the kit for removing adhesives from a surface that includes a solvent composition of dimethyl adipate and dimethyl glutarate.

According to yet another embodiment of the present invention, the kit for removing adhesives from a surface that includes a solvent composition composed of between about 10 to about 60% by weight of benzyl alcohol; between about 1% to about 25% by weight of glycol ether; and between about 20% to about 65% by weight of dimethyl glutarate According to yet another embodiment of the present invention, the kit for removing adhesives from a surface that includes a solvent composition composed of between about 1% to about 40% by weight of dimethyl adipate and from between about 10 to about 60% by weight of dimethyl glutarate.

According to yet another embodiment of the present invention, a method for removing adhesives from a surface that includes providing a micro-abrasive material, such as a foam, and a solvent composition. The solvent composition is applied to the adhesive and the micro-abrasive material is rubbed repeatedly on the adhesive.

According to yet another embodiment of the present invention, the method for removing adhesives wherein the micro-abrasive material is an open cell foam.

According to yet another embodiment of the present invention, the method for removing adhesives from a surface that includes a solvent composition that is composed of an alcohol, an ether, and a diacid ester.

According to yet another embodiment of the present invention, the method for removing adhesives from a surface that includes a solvent composition that is composed of a benzyl alcohol, glycol ether, and dimethyl glutarate.

According to yet another embodiment of the present invention, the method for removing adhesives from a surface that includes diacid esters.

According to yet another embodiment of the present invention, the method for removing adhesives from a surface that includes a solvent composition composed of dimethyl adipate and dimethyl glutarate.

According to yet another embodiment of the present invention, the method for removing adhesives from a surface that includes a foam composed of formaldehyde-melamine-sodium bisulfite copolymer.

According to an embodiment of the present invention, a device for removing adhesives from a surface that includes a micro-abrasive material, such as a foam, and a solvent disposed on the surface of the foam.

According to another embodiment of the present invention, the device for removing adhesives from a surface includes a micro-abrasive material that is an open cell foam.

BRIEF DESCRIPTION OF THE DRAWINGS

The present invention is illustrated and described herein with reference to the various drawings, in which like reference numbers denote like method steps and/or system components, respectively, and in which:

FIG. 1 is a perspective view of a kit of the present invention.

DETAILED DESCRIPTION OF THE INVENTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Referring now specifically to the drawings, an example of a kit for the removal of an adhesive from a hard surface is illustrated in FIG. 1 and is shown generally at reference numeral 10. The kit 10 of the present invention consists of a solvent composition 12 (shown engaged to a disposable cloth) and a micro-abrasive material, such as an open cell foam 14. The kit 10 may contain a container, housing or packaging for housing the solvent composition 12 and foam 14 or micro-abrasive material. The solvent composition 12 may be disposed on a disposable cloth, such as a towel, a wipe, or the like that that is stored within a container for preventing the disposable cloth from drying out. The disposable cloths are pre-wet with the solvent composition 12 and stored within a generally air-tight container, allowing them to be removed when the user desires.

Alternatively, the solvent composition 12 may be stored within a canister, such as an aerosol can, for dispensing the solvent composition as an aerosol or a foam. In yet another embodiment, the solvent composition 12 may be stored within a pump sprayer. The solvent composition 12 is then applied to an adhesive on a hard surface, depositing some of the solvent composition 12 on the adhesive. The foam 14 is then repeatedly rubbed over the adhesive, causing the removal of the adhesive without damaging the hard surface.

The solvent composition 12 may be composed of an alcohol, an ether, and a diacid ester. The alcohol may be benzyl alcohol, the ether may be glycol ether, and the diacid ester may be dimethyl glutarate. The solvent composition 12 may contain between about 10 to about 60% by weight, preferably between about 20% to about 50% by weight, and more preferably between about 30% to about 40% by weight of benzyl alcohol; between about 1% to about 25% by weight, preferably between about 4% to about 20% by weight, and more preferably between about 7% to about 15% by weight of glycol ether; and between about 20% to about 65% by weight, preferably between about 30% to about 55% by weight, and more preferably between about 40% to about 45% by weight of dimethyl glutarate. The solvent composition 12 may optionally contain diluents or inert media is the active ingredients listed above do not total 100% of the solvent composition. An inert media may be water, glycols, or other non-active solvents.

Alternatively, the solvent composition 12 may be composed of diacid esters. These esters may be dimethyl adipate and dimethyl glutarate. The solvent composition may contain between about 1% to about 40% by weight, preferably between about 4% to about 25% by weight, and more preferably between about 9% to about 18% by weight of dimethyl adipate and from between about 10 to about 60% by weight, preferably between about 20 to about 45% by weight, and more preferably between about 28 to about 35% by weight of dimethyl glutarate. The solvent composition 12 may optionally contain diluents or inert media is the active ingredients listed above do not total 100% of the solvent composition. An inert media may be water, glycols, or other non-active solvents.

The solvent composition 12 is thoroughly mixed to form a homogenous composition. The solvent composition 12 may be combined with the open cell foam 14. The open cell foam 14 may be a block, rectangularly shaped, square shaped, or may be another shape as desired by the user, such as circular or triangular. The open cell foam 14 is preferably a melamine foam, consisting of formaldehyde-melamine-sodium bisulfite copolymer. BASF currently sells a melamine foam called Basotect that is commercially available as Mr. Clean's Magic Eraser. The solvent composition 12 is applied to the adhesive by wiping it with the disposable cloth containing the solvent composition 12, or spraying the adhesive with solvent composition 12 from a canister or spray can. Alternatively, the solvent composition 12 may be applied directly to the foam 14. The foam 14 is then applied to the adhesive, depositing the solvent composition 12 on the adhesive. The foam 14 is then repeateadly rubbed over the surface of the adhesive.

Comparative Example 1

Approximately 900 sq. ft. of length scraped Mable Engineered flooring was installed on concrete. Roberts R1530 All-in-One Moisture Cure Urethane was used at the adhesive to install the flooring. The adhesive was left on the flooring and allowed to cure on at least half of the flooring. Mineral spirits was applied to a cloth and the adhesive was attempted to be removed. The mineral spirits failed to remove the adhesive.

Comparative Example 2

Approximately 900 sq. ft. of length scraped Mable Engineered flooring was installed on concrete. Roberts R1530 All-in-One Moisture Cure Urethane was used at the adhesive to install the flooring. The adhesive was left on the flooring and allowed to cure on at least half of the flooring. Paint thinner was applied to a cloth and the adhesive was attempted to be removed. The paint thinner failed to remove the adhesive.

Comparative Example 3

Approximately 900 sq. ft. of length scraped Mable Engineered flooring was installed on concrete. Roberts R1530 All-in-One Moisture Cure Urethane was used at the adhesive to install the flooring. The adhesive was left on the flooring and allowed to cure on at least half of the flooring. Roberts R5505 wipes were used in an attempt to remove the adhesive. The Roberts R5505 failed to remove the adhesive.

Comparative Example 4

Approximately 900 sq. ft. of length scraped Mable Engineered flooring was installed on concrete. Roberts R1530 All-in-One Moisture Cure Urethane was used at the adhesive to install the flooring. The adhesive was left on the flooring and allowed to cure on at least half of the flooring. DriTac wipes were used in an attempt to remove the adhesive. The DriTac wipes failed to remove the adhesive.

Example 1

Approximately 900 sq. ft. of length scraped Mable Engineered flooring was installed on concrete. Roberts R1530 All-in-One Moisture Cure Urethane was used at the adhesive to install the flooring. The adhesive was left on the flooring and allowed to cure on at least half of the flooring. The device according to the present invention was used in an attempt to remove the adhesive. The device was rubbed over the adhesive and the adhesive was removed from the flooring, without damaging the flooring.

Example 2

Approximately 900 sq. ft. of length scraped Mable Engineered flooring was installed on concrete. Roberts R1530 All-in-One Moisture Cure Urethane was used at the adhesive to install the flooring. The adhesive was left on the flooring and allowed to cure on at least half of the flooring. The pre-wet wipe, containing the solvent composition was rubbed over the adhesive, depositing the solvent composition on the adhesive. The open cell foam was immediately rubbed over the adhesive in an attempt to remove the adhesive, causing the adhesive to be removed from the flooring, without damaging the flooring.

The present invention also consists of a method for removing adhesives from a hard surface. The method of the present invention includes the application of a solvent composition 12 from a pre-wet. solvent containing disposable cloth to an adhesive, and repeatedly rubbing the micro-abrasive material, such as a foam 14, on the adhesive, causing the removal of the adhesive without damaging the floor. Specifically, the method includes applying a solvent composition 12 composed of either 1) benzyl alcohol, glycol ether, dimethyl glutarate or 2) dimethyl adipate and dimethyl glutarate to the adhesive and rubbing the adhesive with an open cell foam 14, such as a melamine foam, causing the adhesive to be removed without damaging the floor.

In one practice of the present invention, a solvent composition 12 is introduced to the open cell foam 14, allowing the solvent composition 12 to be absorbed between the interstitial spaces in the open cell foam 14. The solvent composition 12 also coats at least one external side of the open cell foam 14 or may only be applied to one side of the open cell foam 14. The foam 14 is then rubbed over an adhesive on a hard surface for removing the adhesive. Alternatively, the solvent composition 12 may be applied to a towel, wipe, or the like and applied to the adhesive, wherein immediately the open cell foam 14 is rubbed over the adhesive for removal.

The solvent composition 12 may be stored within a canister, such as an aerosol can, for dispensing the solvent composition 12 as an aerosol or a foam. In yet another embodiment, the solvent composition 12 may be stored within an aliquot or a pump sprayer. The solvent composition 12 is then applied to an adhesive on a hard surface, depositing some of the solvent composition 12 on the adhesive. The micro-abrasive material, such as foam 14, is then repeatedly rubbed over the adhesive, causing the removal of the adhesive without damaging the hard surface.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A kit for removing a cured adhesive on a wood flooring surface, comprising:

a micro-abrasive material; and a solvent composition comprised of about 15% diethylene glycol butyl ether, 40% benzyl alcohol, and 45% dimethyl glutarate that can remove a cured adhesive in conjunction with the micro-abrasive material, the micro-abrasive material when rubbed over the adhesive, causes the cured adhesive to be removed from the wood flooring, without damaging the underlying wood flooring.

2. The kit according to claim 1, wherein the micro-abrasive material is an open cell foam.

3. The kit according to claim 1, wherein the solvent composition is contained on a disposable cloth.

4. The kit according to claim 2, wherein the foam and solvent composition are stored within a housing.

5. The kit according to claim 1, wherein the micro-abrasive material is a melamine foam.

6. A kit for removing a cured urethane adhesive on a wood flooring surface, consisting essentially of:

a micro-abrasive material; and a solvent composition comprised of about 15% diethylene glycol butyl ether, 40% benzyl alcohol, and 45% dimethyl glutarate that is used with the micro-abrasive material, the micro-abrasive material containing the solvent composition, when rubbed over the cured adhesive, causes the cured adhesive to be removed from the wood flooring without damaging the underlying wood flooring surface.

7. The kit according to claim 6, wherein the micro-abrasive material is an open cell foam.

8. The kit according to claim 6, wherein the solvent composition is contained on a disposable cloth.

* * * * *